United States Patent [19]

Seifert et al.

[11] 3,970,548

[45] July 20, 1976

[54] APPARATUS FOR SCREENING PAPER FIBER STOCK

[75] Inventors: Peter Seifert; David E. Chupka, both of Middletown, Ohio

[73] Assignee: The Black Clawson Company, Middletown, Ohio

[22] Filed: June 2, 1975

[21] Appl. No.: 582,867

Related U.S. Application Data

[63] Continuation-in-part of Ser. No. 391,574, Aug. 27, 1973, abandoned.

[52] U.S. Cl. ..... 209/240; 209/273; 209/306; 209/379

[51] Int. Cl.[2] ..... B07B 1/20

[58] Field of Search.... 209/273, 270, 303, 304–306, 209/379, 243, 240; 210/45

[56] References Cited

UNITED STATES PATENTS

| | | | |
|---|---|---|---|
| 2,975,899 | 3/1961 | Cannon | 209/273 |
| 3,410,409 | 11/1968 | Rittenhouse | 209/273 X |
| 3,726,401 | 4/1973 | Bolton | 209/306 X |
| 3,759,392 | 9/1973 | Syrjanen | 209/273 X |

FOREIGN PATENTS OR APPLICATIONS

| | | | |
|---|---|---|---|
| 203,353 | 10/1958 | Austria | 209/304 |
| 735,273 | 5/1966 | Canada | 209/273 |
| 727,010 | 2/1966 | Canada | 162/4 |
| 563,239 | 9/1923 | France | 209/304 |
| 320,509 | 11/1913 | Germany | 209/304 |

*Primary Examiner*—Robert Halper
*Attorney, Agent, or Firm*—Biebel, French & Nauman

[57] ABSTRACT

Screening apparatus for paper fiber stock and other fiber suspension is especially designed to handle relatively suspension containing stringy material. A perforate screen cylinder forms the outer wall of the supply chamber for the stock to be screened, and a rotor operates in the supply chamber and includes vanes which travel in spaced relation with the inner wall of the screen cylinder. These vanes are supported on the rotor hub by imperforate arms of substantial axial extent which act as propeller blades to maintain a high rate of circulation of the stock within the supply chamber and also to direct the stock toward the reject collecting chamber from which stock is continuously discharged at a high volumetric rate approaching or equal to the rate of discharge of accepted stock. Helical ribs on the inner surface of the screen cylinder aid in channeling the flow of reject-containing stock toward the reject outlet.

6 Claims, 11 Drawing Figures

APPARATUS FOR SCREENING PAPER FIBER STOCK

CROSS-REFERENCE TO RELATED APPLICATIONS

This application is a continuation-in-part of our application Ser. No. 391,574 filed Aug. 27, 1973 and now abandoned. Reference is also made to Chupka U.S. Pat. No. 3,873,410, Seifert U.S. Pat. No. 3,849,302, and Seifert application Ser. No. 496,160, filed Aug. 9, 1974.

BACKGROUND OF THE INVENTION

Paper mills have for many years made extensive use, for the cleaning of paper making stock, of screening apparatus embodying a cylindrical perforate screen member defining supply and accepts chambers on the opposite sides thereof in a closed housing and provided with a rotor member which operates in one of the chambers to keep the screen perforations open and free from solid material tending to cling to the screen surface. Commonly, the stock or furnish is delivered to the supply chamber adjacent the end of the screen member, and the material rejected by the screen member is collected and discharged from the opposite end of the screen member.

The assignee of this invention has manufactured and sold many such screens, originally in accordance with Staege U.S. Pat. No. 2,347,716, and more recently in accordance with Martindale U.S. Pat. No. 2,835,173, the latter construction being characterized by a rotor comprising bars or vanes of air-foil section in closely spaced but non-contacting relation with the surface of the screen member. More specifically, these vanes have been moved along the screening surface at relatively low speeds, e.g. in the range of 1,250 – 2,500 feet per minute, with the clearance between the supply side of the screen member and the nearest portion of the vanes being in the range of 0.030 – 0.060 inch.

The art has experimented widely with detailed variation in screens of the above type, including variations in the vane shape and other forms of rotor, and in the size, spacing and configuration of the perforations in the screen member. For example, such screens have recently been offered to the trade wherein the rotor is a wall member provided with multiple bumps or other offset portions over its surface for the purpose of creating localized changes in volume and resulting localized agitation effects in the annular space between the rotor and the screen member, a typical such construction being shown in Clarke-Pounder U.S. Pat. No. 3,363,759. The variations in the perforations in the screen member have tended in recent years to result in screen members provided with elongated slots rather than round holes, typical such constructions being shown in Lamort U.S. Pat. Nos., 3,161,708 and 3,174,622 and Holz U.S. Pat. No. 3,581,983.

The above noted Seifert patent and application disclose screens generally of the same construction as in the Martindale patent, incorporating both slotted (U.S. Pat. No. 3,849,302) and circularly perforated (Ser. No. 496,160) screen members, and having rotors especially constructed to maintain the vanes spaced away from the screen member on its inlet side by a sufficient distance to establish a tubular layer of stock of substantial thickness adjacent the inlet surface of the screen member. In the use of those screens, the rotor is operated at relatively high speeds to develop strong hydraulic shear forces in the tubular layer of stock adjacent the screen member which cause tangential orientation of predominantly two-dimensional contaminant particles causing them to flow past rather than through the screen perforations. In addition, the stock is continuously recirculated in the supply chamber to prevent undue increase in the consistency of the stock in the tubular layer, thereby, providing for screening at high consistencies as well as high throughput rates.

Screens constructed in accordance with the Seifert patent and application have proved very successful in handling reasonably clean stock, but they have encountered problems in the handling of relatively dirty stock, and particularly stock having multiple stringy contaminants such, for example, as stock containing fiber salvaged from municipal waste as disclosed in U.S. Pat. No. 3,736,223. The stringy material present in such stocks has a tendency to collect on the rotor, particularly by folding over or wrapping around the bars used to mount the vanes on the rotor hub as shown in the Martindale patent, with resulting decrease in screening efficiency as well as overloading of the rotor and drive. Similar problems occur with other long fiber suspensions such, for example, as synthetic fibers used in making non-woven fabric, which are frequently of such length as to tend to form strings.

SUMMARY OF THE INVENTION

The primary object of the present invention is to provide a screen generally of the construction shown in the Martindale patents wherein the rotor is especially constructed to minimize problems resulting from the presence of stringy materials in the supply chamber, and to enable the screen to handle such long fiber suspension successfully over a substantial range of consistencies.

This result is accomplished by means of a rotor construction wherein each vane is supported on the rotor hub by an imperforate arm of substantial axial extent, e.g. 5 inches, rather than the pair of spaced rods previously used for this purpose. Two major results flow from this construction. First, the arms are of such dimensions that whatever string material is present in the feed of stock is not long enough to fold over an arm, and therefore will remain in suspension for removal with other reject materials, thereby solving the problems encountered by previous such screens.

The second result is twofold. The vane-supporting arms present imperforate leading surfaces which act as propeller blades causing increased circulation of the stock in the annular portion of the supply chamber between the vanes and the hub. Also, the arms can be tilted with respect to the axis and direction of rotation of the rotor so that they can increase or decrease the axial velocity component in the circulating stock and this velocity component will have maximum value adjacent their outer ends where their linear speed is highest.

The effect of these conditions will be to impart an axial component to the circulatory force applied to the stock in the space located radially inwardly of the vanes. Further, by reason of the linear speed differential between the stock adjacent the outer and inner peripheries of this space, the outer part of this stock will tend to move axially at a correspondingly higher rate than the inner part, thereby promoting recirculation in the outer part of the supply chamber toward the reject outlet and back toward the inlet end of the chamber in the space adjacent the hub.

This axial recirculation is important, because it will induce increased axial movement of the stock in the tubular layer between the vanes and the impeller, minimizing the tendency of the stock in that layer to thicken while increasing the migration of reject particles toward the reject outlet. On the other hand, it is not desirable for reject material to recirculate axially, and in handling dirty stock, this effect is controlled by adjusting the reject outlet to maintain a relatively high rate of discharge flow of stock containing reject material e.g. 30–50 percent of the supply feed. In screening stocks of normal cleanliness, however, the reject rate can be substantially lower.

Another feature of the invention which is especially important in handling dirty stock is the provision of spiral ribs on the inlet side of the screen member which are arranged at a relatively small helix angle, e.g. 10°–20° to a radial plane normal to the rotor axis, such that the helically curved vanes cross them at approximately right angles. These ribs are of sufficient radial extent to channel the reject-containing stock toward the reject outlet, and there is minimum tendency toward a shearing action between them and the vanes.

A screen constructed and operating as summarized in the preceding paragraphs is especially effective for handling dirty stock, because the stringy material and other reject particles too large to pass through the screen perforations will be constantly urged toward the reject outlet, from which they can advantageously be subjected to coarse screening in a tailing screen and recirculation back to the primary screen. The axial movement of the stock inwardly of the vanes will also induce increased downward movement of the stock in the tubular layer immediately adjacent the inlet side of the screen member, thereby having the advantageous effect of continually changing the stock in the outer tubular layer and preventing undue thickening thereof by accumulation of reject particles which could interfere with screening efficiency.

By reason of the fact that the screens and screening action of the invention are especially useful for the handling of dirty stock, the preferred practice of the invention contemplates the use of screen cylinders provided with circular screen holes rather than slots, because slotted screen cylinders are less rugged than perforated cylinders of the same wall thickness and are correspondingly more subject to damage by dirt particles in the stock. Otherwise, however, the invention is equally applicable to screens incorporating slotted screen cylinders.

DESCRIPTION OF THE PREFERRED EMBODIMENTS

Figure 1:
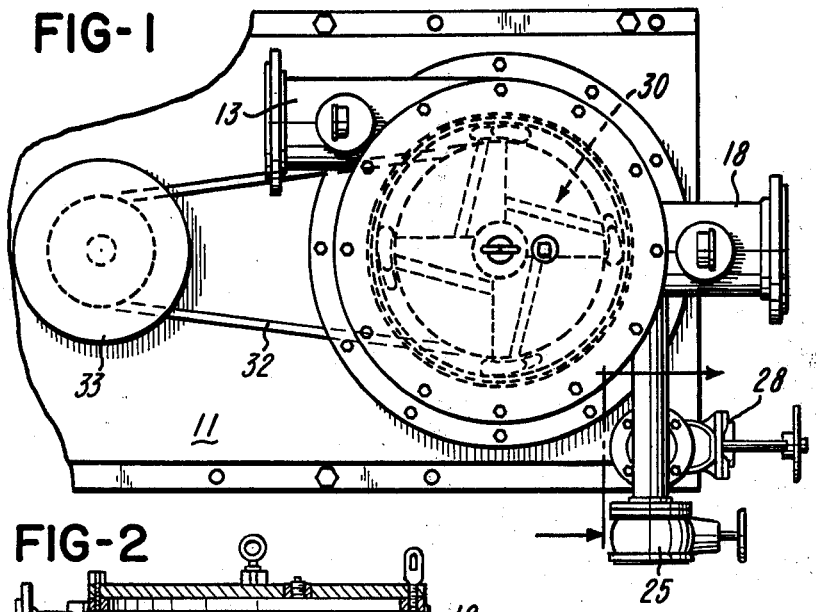
FIG. 1 is a plan view of a pressure screen constructed in accordance with the invention.
Figure 3:
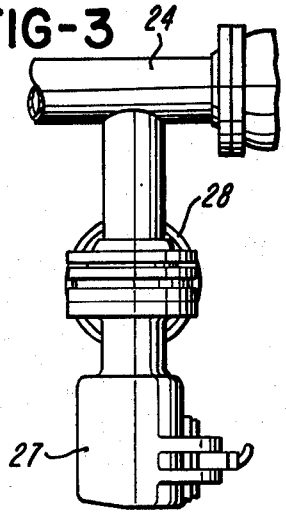
FIG. 3 is a fragmentary elevation taken as indicated by the line 3—3 in FIG. 1.

The screening apparatus shown in the drawing is constructed generally in accordance with the Martindale patent, with certain exceptions in accordance with the invention. It comprises a main housing 10 on a base 11, and at the upper end of the housing is an inlet chamber 12 having a tangential inlet port 13 to which the furnish is supplied under pressure as is customary with such screening apparatus. A cylindrical screen member 15 divides the interior of the housing below chamber 12 into a central supply chamber 16 and an annular accepts chamber 17 having an outlet port 18. The screen member 15 is provided with multiple perforations 20 which may be of conventional size and spacing, typical dimensions being a diameter of 0.062 inch for circular holes with a sufficient number of holes to provide an open area in the range of 10–15 percent, or slots of the sizes and spacings disclosed in the above Seifer U.S. Pat. No. 3,849,302.

Below the bottom wall 22 of the accepts chamber 17 is a reject collecting chamber 23 having a discharge port 24 provided with a control valve assembly 25 which can be preset to provide a desired continual bleed of reject-rich stock. Heavy particles which travel into the chamber 23 and out through port 24 drop therefrom through pipe 26 to the heavy trash collection box 27 by way of manually controlled valve 28. The outlet port 18 and valve 25 should be proportional to provide an outlet flow which is a substantial fraction of the total feed flow to inlet port 13, e.g. 30 to 50 percent, which, as noted above, it may advantageously be supplied to a tailing screen from which the accepted stock is recirculated to the inlet port 13. The valve 25 should therefore be capable of being fully open for unobstructed discharge of a high rate of reject flow, but it should be capable of adjustment to smaller volume settings for a reduced rate of reject flow when its screen is used with relatively clean stock.

A rotor 30 is supported on a drive shaft 31 in the center of the supply chamber 16 and is driven through a belt 32 by a motor 33 also mounted on the base 11. The rotor includes four vanes or bars 35, shown as of the same helical configuration as in the Martindale patent, each of which is mounted on the rotor hub 36 by an arm 40 of generally channel shape comprising a central section 41 and upper and lower flanges 42 and 43 which cooperate to provide great strength and rigidity.

Figure 4:
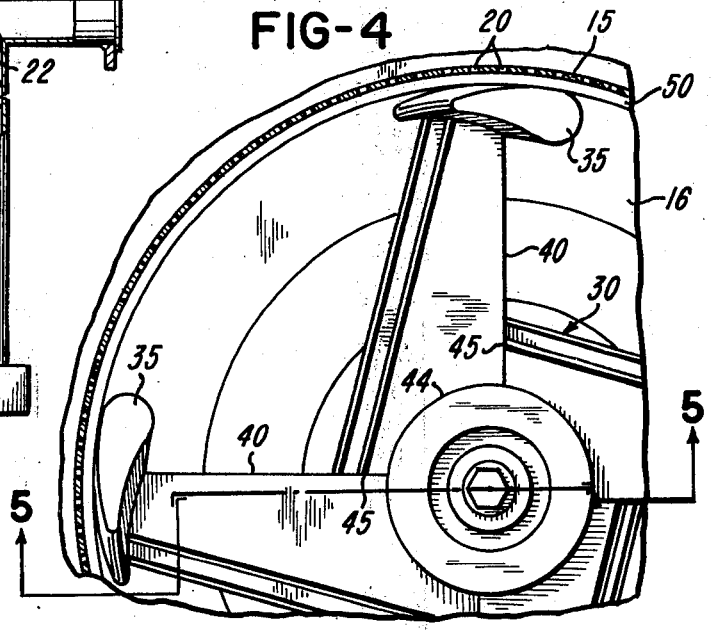
FIG. 4 is an enlarged top view of a fraction of the screen chamber and rotor of the screen of FIGS. 1–2.
Figure 5:
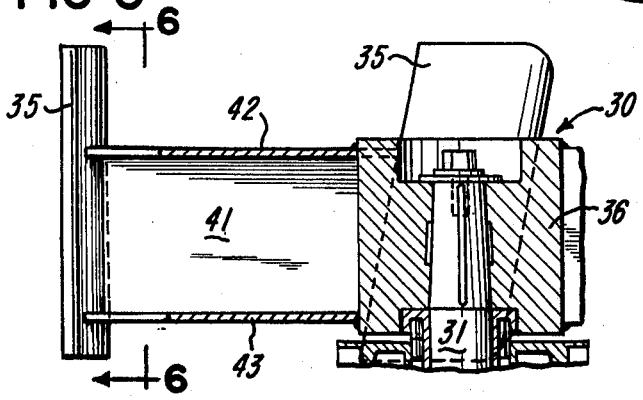
FIG. 5 is a detail view of a portion of the rotor of FIG. 4.
Figure 6:
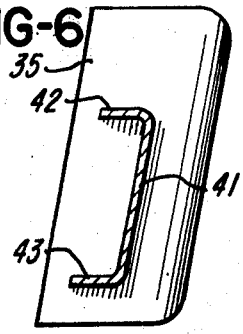
FIG. 6 is a detail section on the line 6—6 of FIG. 5.

As best seen in FIGS. 4–6, each arm 40 is smallest at its radially outer end which is welded to the associated vane 35. The radially inner end of each arm is cut arcuately at 44 to fit and be welded to the hub 36, and the flanges 42 and 43 taper outwardly toward the hub and are welded at 45 to the center section of the following arm 40 so that each arm effectively braces the adjacent arms.

The central portion of 41 of each arm 40 presents an imperforate surface of substantially greater axial extent than the length of any stringy material which can normally be expected to be present in the stock being screened, e.g. an axial dimension of the order of 5 inches in a screen wherein the axial dimension of the screen cylinder 15 is 12 inches and the diameter of member 15 is 24 inches. In addition, as best seen in FIGS. 4–6, the vanes 35 are helically curved so that their upper ends lead their lower ends in their direction of rotation, and the arms 40 are so constructed and arranged that each central portion is inclined forwardly and downwardly in its direction of rotation so that its leading surface forms a propeller blade acting to circulate stock in the supply chamber 16 with an axially downward component toward the reject collecting chamber 22.

On the inner surface of screen member 15 are two ribs 50 each of such length and helical curvature that it extends from one end of member 15 to the other at a helix angle between 10° and 20° to the horizontal. The radial thickness of each of these ribs should preferably almost equal the thickness of the tubular layer of furnish between the surface of screen member 15 and the vanes 35. At the preferred spacing of the vanes of 7/16 inch from the inner surface of screen member 15, each rib may be of rectangular section which is ¼ inch in radial thickness and ½ inch wide. With these dimensions, the ribs will channel this stock so that it follows a generally helical downward path within the supply chamber, and with the helix angle of the ribs 50 such that they are approximately normal to the forwardly tilted vanes 35 as described, there is minimum tendency for the vanes and ribs to have relative shearing action on reject material.

In operation with this screen, the supply flow of stock through the inlet port 13 enters the housing 10 tangentially so that it is already circulating in the direction of rotation of the rotor 30 when it enters the supply chamber 16, and this circulatory movement is intensified by rotation of the rotor at a substantial speed, e.g. 800 rpm. With the vanes 35 spaced radially inwardly of the surface of the screen, conditions of hydraulic sheer will be set up in the tubular layer of stock between the vanes and the screen causing elongated reject particles to be aligned generally tangentially of the surface of the screen so that they will avoid passing through any of the perforations 16.

The flow in this tubular layer will be channeled downwardly by the ribs 50 toward the reject collecting chamber 22. At the same time, the stock in the space lying between the vanes 35 and the rotor hub 36 will be forced by the propeller action of the arms 40 to circulate circumferentially of this space with a downward component, and since the outer portions of the stock in this space will be moving at faster linear rates than the inner portions, they will have increased carrying capacity for reject particles and will tend to transport these particles, such particularly as stringy materials, toward the chamber 22.

Figure 2:
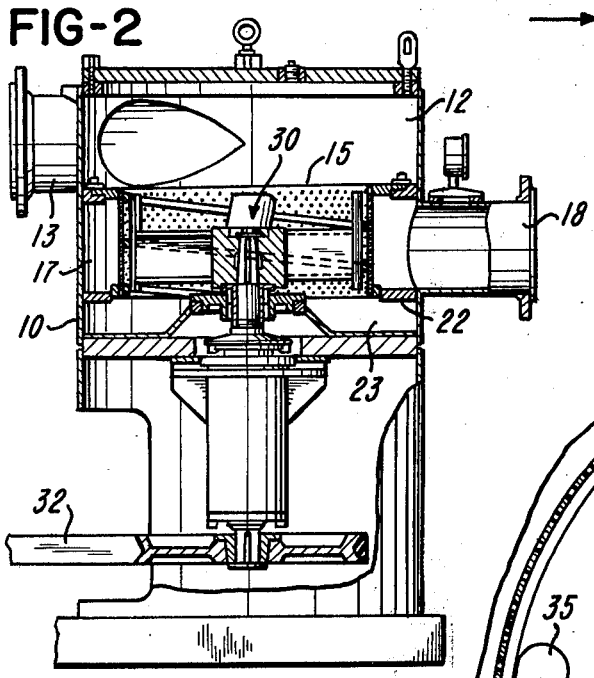
FIG. 2 is a section on the line 2—2 in FIG. 1.

As noted, and as shown in FIG. 2, the outer diameter of the chamber 22 is substantially larger than that of the screen member 15 which defines the outer wall of the supply chamber 16. Therefore, as soon as stock enters the chamber 22, from the chamber 16, it can flow radially outwardly with the reject material being carried thereby. But since there is no force directly causing circulation of stock in the chamber 22, the linear speed of the stock will tend to decrease and correspondingly decrease its ability to carry reject material back and up toward the upper end of the space 16.

Under these operating conditions, with the reject outlet port 24 controlled to provide a discharge flow not substantially less than the rate of flow of accepted stock from the port 18, e.g. 30 to 50 percent of the supply flow, the reject material which reaches the chamber 22 will be continuously discharged and thus have minimum tendency toward recirculation within the screen. This screen and its mode of operation are therefore especially applicable to the handling of dirty stocks containing excessively stringy materials because these materials will be transported through the screen relatively rapidly, with minimum opportunity either for inclusion with accepted stock or for accumulation on any part of the apparatus within the supply chamber. Such material therefore has minimum opportunity for clogging or otherwise interfering with the acceptable stock which is continuously screened through the perforations 16 to the accepts chamber 17 for discharge through its outlet port 18.

The screens of the invention are also especially useful in handling long fiber suspensions other than paper making stock, a typical example being a suspension of synthetic fibers to be used in the making of non-woven fabric. Such fibers are commonly of lengths substantially greater than paper fibers, and this leds to a tendency for them to form strings of sufficient length to catch on vane-supporting rods such as are shown in Martindale U.S. Pat. No. 2,835,173. The vane-supporting arms of the invention, however, prevent this result and thereby promote effective screening of such long fiber suspensions.

The operating conditions of a screen constructed as summarized above also contribute to the ability of the screen to handle relatively high consistency stock, e.g. 3–5 percent, even with screen members having relatively small perforations such as 0.062 inch in diameter. The high energy input to the stock makes it possible to move high consistency stock through the screen with minimum tendency toward localized thickening, and the reject material can be discharged at whatever rate suits the conditions of the particular stock, including substantially the same volumetric rate as the accepted stock for very dirty stock. As a result, screens in accordance with the invention will function satisfactorily as primary screens even for receiving pulped solid waste which is extracted at pulping consistencies of 3–5 percent directly from a pulper through holes of the order of 1 to 2 inches in diameter and with only an intermediate centrifugal cleaning step for eliminating high specific gravity contaminants, as disclosed in the above noted Chupka U.S. Pat. No. 3,873,410. This capacity of these screens provides the further advantage that all low specific gravity reject material is removed from the main flow at a single station, rather than at successive stations as in the case where coarse and fine screens are connected in series.

Figure 7:
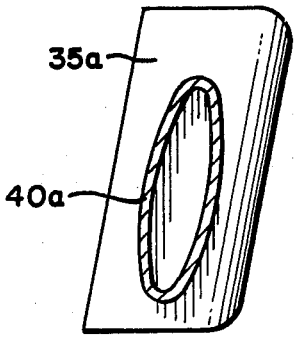
FIGS. 7–11 are detailed views similar to FIG. 6 and showing other forms of vane-supporting arms in accordance with the invention.
Figure 8:
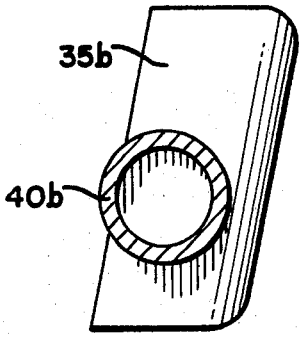

While arms 40 of the particular construction and arrangement shown have given excellent results in test operations, the principles of the invention can be embodied in arms of other cross sectional shapes so long as they are of sufficient proportions axially of the rotor to minimize the possibility of stringy reject material folding thereover. Thus FIG. 7 shows a vane **35*a* and supporting arm 40*a* of elongated oblong shape in section. This arm 40*a* is also tilted forwardly in general alignment with the vane 35*a* to produce an axial flow component in a manner similar to the arm 40** as already described.

Figure 9:
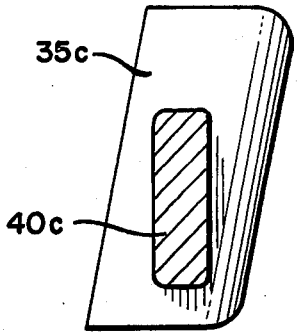

FIGS. 8–11 show other configurations of arms which also can be used successfully in the practice of the invention. Thus in FIG. 8, the arm **40*b* supporting the vane 35*b* is essentially circular in section and of a diameter comparable to the axial extent of the arm 40. FIG. 9 shows a vane 35*c* with a supporting arm 40*c* of solid section and with its width extending essentially axially of the rotor. While this arm 40***c* will not itself produce an axial flow component in the stock, the forward tilt of the vane 35*c* will have that effect as previously described.

Figure 10:
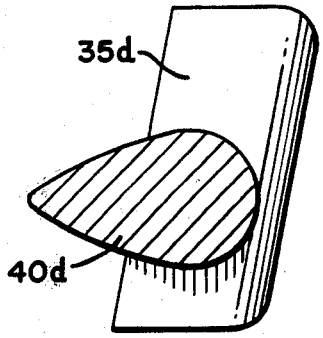
Figure 11:
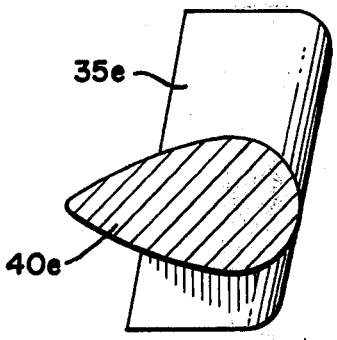

FIGS. 10 and 11 show vanes 35*d* and 35*e* equipped with supporting arms 40*d* and 40*e* respectively, of air foil shapes in section, the arm 40*e* being of somewhat greater length in section than the arm 40*d*, and being attached at its respective vane 35*e* more forwardly the arm 40*d* and vane 35*d*. The arm configuration of FIGS. 10 and 11 will minimize turbulance and the development of an axial flow component in the supply chamber, but there will still be sufficient such axial flow development by reason of the incoming stock and the inclination of the vanes as described.

While the methods herein described, and the forms, of apparatus for carrying these materials into effect, constitute preferred embodiments of this invention, it is to be understood that the invention is not limited to these precise methods and forms of apparatus, and that changes may be made in either without departing from the scope of the invention.

What is claimed is:

1. Screening apparatus for fiber suspensions comprising:

a. a housing, b. a cylindrical screen member within said housing having perforations therethrough and separating the interior thereof into a supply chamber and an accepts chamber on the inside and outside respectively of said screen member, c. inlet means for supplying the suspension to one end of said supply chamber for flow therethrough and screening passage of some thereof through said perforations to said accepts chamber, d. reject outlet means for continuously withdrawing a portion of the suspension from the other end of said supply chamber, e. rotor means including a hub and vanes movable in said supply chamber along a cylindrical path concentric with said screen member, f. means for supporting each of said vanes on said rotor hub in radially inwardly spaced relation with the inner surface of said screen member whereby rotation of said rotor means causes said vanes to define with said screen member an annular space adapted to be filled with suspension, g. means for driving said rotor means to cause said vanes to travel along said path and thereby to cause the suspension in said annular space between said vanes and said screen member to circulate along the surface of said screen member, h. said supporting means for each said vane including only arm means rigidly secured to said vane and said hub, i. each said arm means being an essentially imperforate member of sufficiently greater axial extent than the length of any stringy material which can normally be expected to be present in the suspension to minimize the possibility of stringy material folding thereover, and j. each said arm member presenting a leading surface functioning as a blade causing continuous circulation of the suspension about the center of said supply chamber in the annular space between said vanes and said hub.

2. Screening apparatus as defined in claim 1 wherein each said arm member is inclined with respect to the axis of said rotor means to locate the edge thereof adjacent said inlet means in leading relation with the opposite edge thereof to introduce an axial component into the circulation of the suspension in said supply chamber whereby the suspension closer to said screen member travels axially at a higher rate than the suspension radially inwardly thereof and thereby effects axial circulation as well as radial circulation of the suspension in said supply chamber.

3. Screening apparatus as defined in claim 1 wherein said reject outlet means includes means defining a reject collecting chamber of greater outer diameter than said supply chamber into which suspension in said tubular layer will flow with a radially outward component minimizing the return of reject particles therein to said supply chamber, and means defining an outlet port leading from an outer periphery of said collecting chamber.

4. Screening apparatus as defined in claim 1 further comprising means for controlling the effective area through said reject outlet port to a predetermined substantial fraction of the supply flow to said inlet means.

5. Screening apparatus as defined in claim 1 wherein said vanes are helically curved with the end thereof adjacent said inlet means leading the other end thereof in the direction of rotation of said hub, and said apparatus further comprising at least one rib on the inner surface of said screen member which is helically curved in the opposite direction from said vanes at a helix angle such that each said vane defines an approximately right angle with said rib in moving therepast.

6. Screening apparatus as defined in claim 5 wherein the helix angle of each said rib lies between 10° and 20° to a plane radial to the axis of said rotor.

* * * * *